US011944133B2

(12) United States Patent
Musser

(10) Patent No.: US 11,944,133 B2
(45) Date of Patent: Apr. 2, 2024

(54) CHICKEN COSTUME APPARATUS AND SYSTEM AND METHODS OF USE THEREOF

(71) Applicant: Michelle Musser, San Francisco, CA (US)

(72) Inventor: Michelle Musser, San Francisco, CA (US)

( * ) Notice: Subject to any disclaimer, the term of this patent is extended or adjusted under 35 U.S.C. 154(b) by 90 days.

(21) Appl. No.: 17/367,496

(22) Filed: Jul. 5, 2021

(65) Prior Publication Data

US 2022/0000192 A1 Jan. 6, 2022

Related U.S. Application Data

(60) Provisional application No. 63/048,143, filed on Jul. 5, 2020.

(51) Int. Cl.

| | |
|---|---|
| ***A41D 27/08*** | (2006.01) |
| ***A41D 13/002*** | (2006.01) |
| ***A63J 5/00*** | (2006.01) |
| ***A63J 7/00*** | (2006.01) |

(52) U.S. Cl.

CPC ..... *A41D 13/0025* (2013.01); *A41D 27/08* (2013.01); *A63J 5/00* (2013.01); *A63J 7/005* (2013.01)

(58) Field of Classification Search

CPC .... A41D 13/002; A41D 13/065; A41D 27/02; A41D 27/04; A41D 27/08; A63H 33/00; A63J 5/02

USPC ..... 446/226–228, 28; 2/69

See application file for complete search history.

(56) References Cited

U.S. PATENT DOCUMENTS

| | | | | | |
|---|---|---|---|---|---|
| 3,382,504 | A * | 5/1968 | Barbosa | A41D 1/00 | D2/741 |
| D283,172 | S * | 4/1986 | Johnson | D2/741 | |
| D379,109 | S * | 5/1997 | Van Gendt | D2/741 | |
| 5,742,939 | A * | 4/1998 | Williams | A41D 13/015 | 446/28 |
| 6,041,436 | A * | 3/2000 | Keen | A41D 1/00 | 446/28 |
| 2005/0159072 | A1* | 7/2005 | Brown | A41D 1/002 | 446/26 |
| 2009/0025116 | A1* | 1/2009 | Dapo | A63J 7/005 | 446/28 |

* cited by examiner

*Primary Examiner* — Kien T Nguyen
(74) *Attorney, Agent, or Firm* — Kathleen E. Chaffee

(57) ABSTRACT

This invention refers to a costume apparatus for enabling a user to perform or engage in role-play activities. The costume apparatus may be worn on a user's body, and comprises a character head suitable for covering a head of an individual or user (e.g., having a chicken head appearance); a body pod (e.g., having a chicken skin and chicken body appearance and, optionally, a tail portion); a glove (which can also be a portion of a bodysuit suitable for covering an arm of an individual or user (e.g., having a chicken wing skin appearance); a leg covering (such as leggings or a bodysuit) suitable for covering legs of an individual or user (e.g., having a chicken leg appearance, optionally comprising fishnet stockings or the appearance of fishnet stockings); a removable body pod cover (e.g., having a chicken feather appearance, such as manufactured from artificial fur material); or a glove cover (e.g., having a feathered chicken wing appearance, such as manufactured from an artificial fur material).

15 Claims, 7 Drawing Sheets

FIG. 3A-FIG. 3C
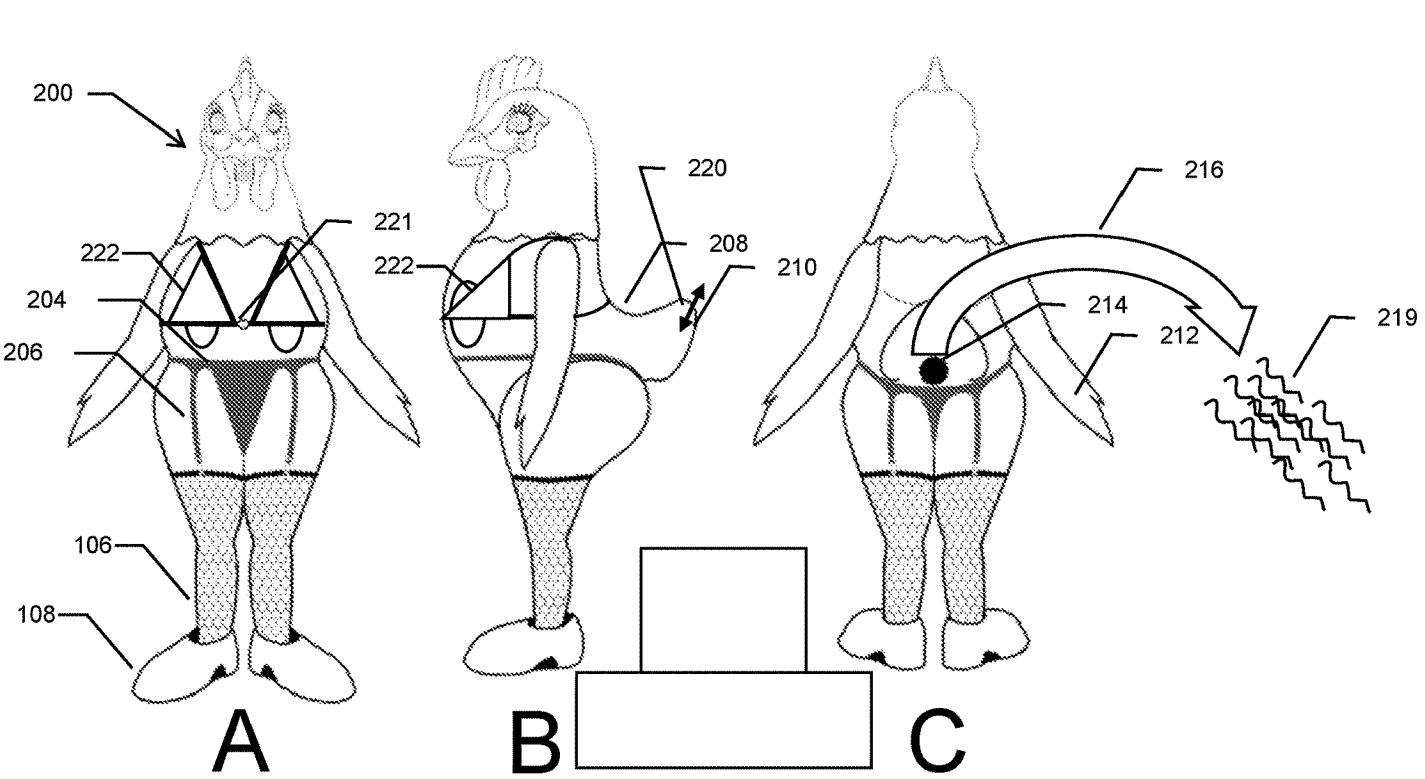
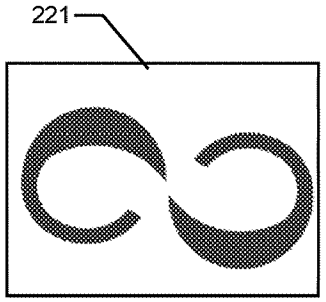

B

A

CHICKEN COSTUME APPARATUS AND SYSTEM AND METHODS OF USE THEREOF

CROSS-REFERENCE TO RELATED APPLICATIONS

This application claims priority from U.S. Provisional Application Ser. No. 63/048,143 filed on 5 Jul. 2020, which is incorporated herein by reference in its entirety.

FIELD

The present disclosure generally relates to costumes for entertainment or performing.

BACKGROUND

Animal costumes are used in many situations such as stage productions, holiday events, and role-playing activities. Over the years, these costumes have utilized a variety of features to improve their appearance and functionality. In one unique aspect of the present invention, the costume has been made to be used in a burlesque show. Ease of putting on or removing a winged costume has been addressed with detachable pads, shoulder and wrist straps, and harnesses. In other aspects, a shaking or wagging motion for tail or tail feathers (e.g., made form artificial or genuine feathers, fur), spinning tassels, and projectile launcher have been made using gas expulsion (e.g., $CO_2$) systems, inflatable components, overlapping plates, or fabric mounted on pivoting rods. Shaking or wagging motion for tail or tail feathers, spinning tassels, and projectile launcher have also been provided by gas expulsion (e.g., $CO_2$), electrical motors, air bellows, or mechanical systems incorporating levers and springs. Unique ways of devising these features as well as other novel elements for chicken costumes can result in improved amusement value and increased functionality for a user or audience.

SUMMARY

This invention refers to a costume apparatus for enabling a user to perform or engage in entertainment-related performances or role-play activities. The costume apparatus may be worn on a user's body, and comprises a character head suitable for covering a head of an individual or user (e.g., having a chicken head appearance); a body pod (e.g., having a chicken skin appearance and body appearance and a tail portion); a glove (which can also be a portion of a bodysuit suitable for covering an arm of an individual or user (e.g., having a chicken wing skin appearance); a leg covering (such as leggings, thigh highs, or a bodysuit) suitable for covering legs of an individual or user (e.g., having a chicken leg appearance (e.g., made from a material having a printed pattern), optionally comprising fishnet stockings or the appearance of fishnet stockings); a removable body pod cover (e.g., having a chicken feather appearance, such as manufactured from artificial fur material); or a glove cover (e.g., having a feathered chicken wing appearance, such as manufactured from an artificial fur material). In some embodiments, the costume apparatus comprises character feet (e.g., having chicken feet appearance). In some embodiments, the costume apparatus comprises costume accessories or accessory component, such as shoes or high heels. In some embodiments, the costume apparatus comprises a projectile launcher (e.g., suitable for launching an egg or an artificial egg). In some embodiments, the costume apparatus comprises costume accessories such as artificial lettuce leaves suitable for use as a burlesque-style fan or feather fan. In some embodiments, the costume apparatus comprises tassels. In some embodiments, the costume apparatus comprises spinning tassels. In some embodiments, the costume apparatus comprises a tail or tail feathers optionally comprising a mechanism to shake the tail or the tail feathers. In some embodiments, the costume apparatus comprises lingerie (e.g., a garter belt, fishnet stockings, leggings having the appearance of chicken legs, leggings having the appearance of fishnet stockings, undergarments, underwear, thong, g-string). In an exemplary embodiment, the ensemble or "hen-semble" comprises a body pod suit having the appearance of chicken skin, the body pod having two holes for a user's legs, a hole for the user's head, sleeve component resembling chicken wings for the user's arms to slide in, made with a fabric or material that resembles chicken skin. The costume can also comprise a component of leggings that appear to be chicken legs with fishnet stockings. The body pod can be covered with a removable chicken feather covering component or body pod cover and removable "gloves" to cover the "chicken wings". The costume can also comprise a feathered chicken head component to cover the user's head. The "naked" body pod can comprise a number of accessories including a removable brassiere, which is a form-fitting undergarment designed to support or cover the chicken breasts, a quick-release clasp, spinning tassels (operable by a clicker or button in the sleeve of the chicken wing or body pod sleeve), a projectile launcher (deployed, actuated, or operable by use of a ring pull system hidden in the garter belt), and accessories including lettuce leaf fan resembling a feathered burlesque fan and costume shoes resembling high-heels.

An aspect of the present disclosure provides for a costume apparatus, comprising: a character head having a chicken head appearance suitable for covering a head of a user; a body pod having a defeathered chicken body shape and defeathered chicken skin appearance; or a removable body pod cover having a chicken feather appearance. In some embodiments, the costume apparatus comprises a pair of first arm coverings suitable for covering arms of a user having a chicken wing skin appearance. In some embodiments, the costume apparatus comprises a pair of second arm coverings having a feathered chicken wing appearance. In some embodiments, the pair of second arm coverings, comprises a material selected from feathers, artificial feathers, or artificial fur. In some embodiments, the costume apparatus comprises a leg covering component suitable for covering the legs of a user. In some embodiments, the leg covering has a chicken leg appearance. In some embodiments, the leg coverings are fishnet stockings or leggings having a pattern of fishnet stockings printed on the leg covering. In some embodiments, the leg covering can be thigh highs, leggings, or a bodysuit. In some embodiments, the pair of first arm coverings is separate, attached, or detachable from the body pod. In some embodiments, the pair of second arm coverings are separate or detachable from the body pod. In some embodiments, the character head has or comprises a cooling fan. In some embodiments, the body pod comprises a cooling fan. In some embodiments, the body pod comprises a tail portion. In some embodiments, the body pod cover comprises a material such as feathers, artificial feathers, or artificial fur material. In some embodiments, the costume apparatus comprises character feet having chicken feet appearance. In some embodiments, the costume apparatus comprises an accessory component selected from shoes, high heels, artificial lettuce leaves suitable for use as a burlesque fan, or a combination thereof. In some embodiments, the costume apparatus a projectile launcher suitable for launching a projectile. In some embodiments, the projectile is confetti, glitter, a ball, an egg, or an artificial egg. In some embodiments, the body pod has a chicken breast portion comprising chicken breast, and the chicken breasts have an operably attached tassel to each breast. In some embodiments, each tassel is actuatable or capable of spinning upon activation (e.g., such as with a button or clicker). In some embodiments, the costume apparatus comprises a tail portion on the body pod or tail feathers on the body pod covering, wherein the body pod comprises a mechanism to shake the tail portion of the body pod with or without the body pod covering comprising tail feathers. In some embodiments, the costume apparatus comprises lingerie. In some embodiments, the lingerie is selected from a brassiere (bra), a garter belt, fishnet stockings, undergarments, underwear, thong, g-string, or a combination thereof. In some embodiments, the lingerie is a brassiere (bra), the brassier having a quick-release clasp. Each additional component can be included in a kit or sold separately as accessories.

Another aspect of the present disclosure provides for a method for entertaining an audience. In some embodiments, the method comprising the steps of: providing a user wearing a costume apparatus described herein; the user performing a first movement comprising removing a first glove cover having a feathered chicken wing appearance; the user performing a second movement of removing a second glove cover having a feathered chicken wing appearance; and/or the user performing a third movement removing the removable body pod cover, wherein the body pod cover has a feathered appearance, from the body pod having a chicken skin appearance. In some embodiments, the method comprises the user performing a movement comprising deploying a projectile from a projectile launcher. In some embodiments, the method further comprises the user performing a movement comprising releasing a brassiere from the body pod, the brassiere having a quick-release clasp. In some embodiments, the user performs a movement comprising actuating tassels operably attached to the body pod. In some embodiments, each movement is performed to a sultry rendition of The Chicken Dance.

Other objects and features will be in part apparent and in part pointed out hereinafter.

DESCRIPTION OF THE DRAWINGS

Those of skill in the art will understand that the drawings, described below, are for illustrative purposes only. The drawings are not intended to limit the scope of the present teachings in any way.

FIG. 2C depicts a further embodiment according to the present invention, in which a costume apparatus is mounted with a projectile launcher.

FIG. 3A-FIG. 3C provides a front view (A), a side view (B), and a rear view (C) of an assembled embodiment of a costume apparatus of the underlying "naked", "defeathered", "plucked", or "stripped" chicken of the costume apparatus of FIG. 1A-FIG. 1C.

FIG. 4B is a close-up view of the quick-release clasp component.

FIG. 6C is an image of the inside of the body pod component (which has the appearance and shape of a chicken). The ovals and arrows point out the leads that are attached to the tassels 202 on the chicken breast portion outside of the body pod. These leads are operably connected to a clicker or button in the sleeve of a chicken wing for ease of access.

DETAILED DESCRIPTION OF THE EMBODIMENTS

The present invention is based, at least in part, on an embodiment of a chicken costume. The chicken costume can comprise: a chicken (e.g., foam character head optionally with cooling fan); a chicken skin body pod (to appear like chicken skin); a chicken skin body suit (to fit the user under the body pod and/or on portions of the user's body not covered by the body pod); removable fur to cover the body pod (to look like chicken feathers) to go over the chicken skin body pod; character leggings or stockings (can be placed over the chicken skin body suit or incorporated into the aforementioned chicken skin body suit); character feet or shoes or high heels; chicken skin mitts/gloves (also can be incorporated into the aforementioned body suit or leggings); chicken feather mitts/gloves (e.g., made of fur to appear like feathers) capable of being worn over the chicken skin gloves or body suit; a projectile (e.g., egg, artificial egg) launcher; shipping container, storage trunk, duffle bag, or storage bag/container; and/or one or more (e.g., two prop lettuce leaves for use as burlesque "feather fans"). Actuating or deploying components can include any desired deployment mechanism or system for use to deploy or actuate such devices. For example, the costume apparatus can use one or more ring-pull(s), button(s), clicker(s), switch(es), levers, etc.

Embodiments according to the present invention shall now be described in more detail in reference to the accompanying figures. In this disclosure, a "body pod" shall be described as a wearable configuration but may also refer to other types of configurations such as a shell or a body costume. The term "actuating" is described as a button or cords used to actuate or activate a costume apparatus feature (e.g., spinning tassels, projectile launcher, tail/tail feather shaker), but may also refer to wires, fabric straps, plastic tubing, or the like. Although the costume described in this disclosure is illustrated in the shape of a chicken, other shapes or animals are possible such as other animals, birds, or feathered animals. The term "costume" can be used to describe an apparatus, assembly, ensemble, or component thereof.

Figures 1A, 1B, 1C:
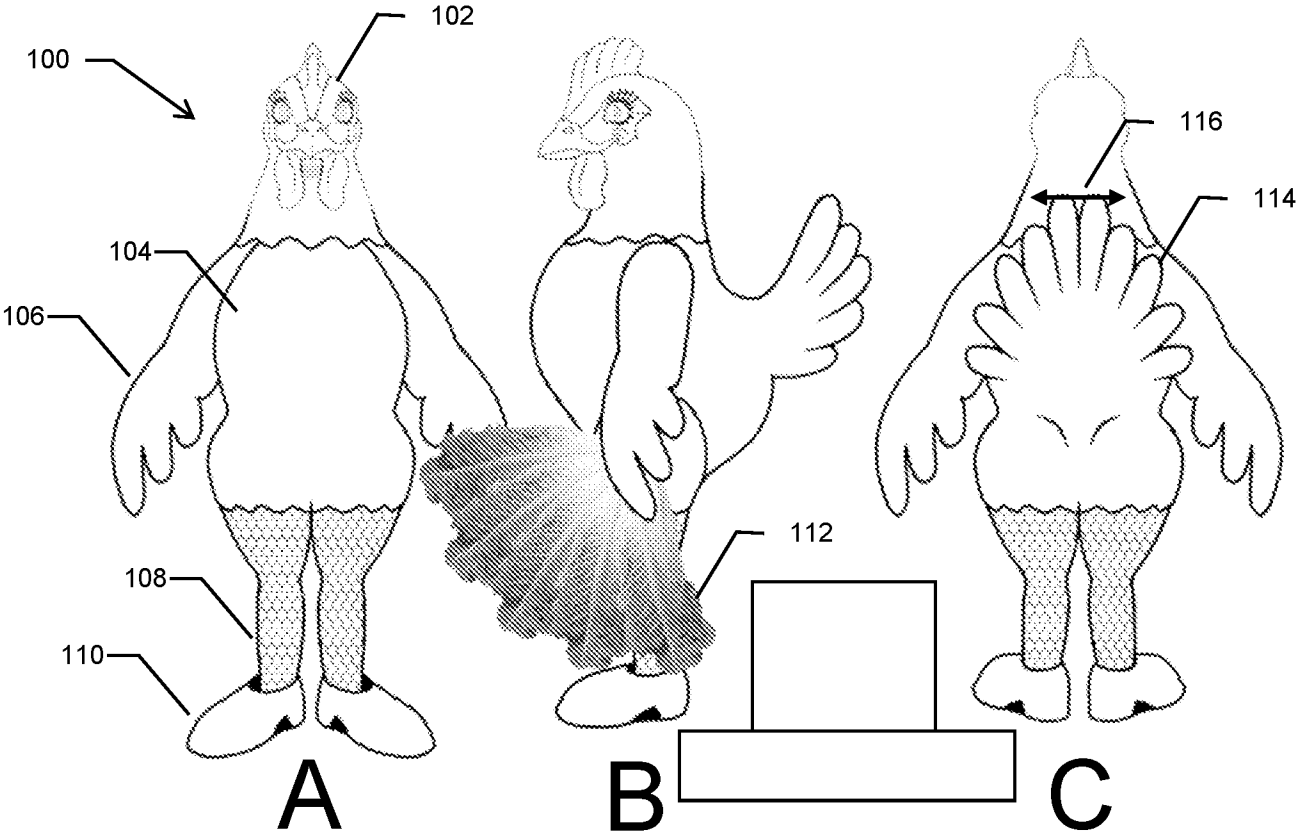
FIG. 1A-FIG. 1C provides a front view (A), a side view (B), and a rear view (C) of an assembled embodiment of a costume apparatus according to the present invention (i.e., the "feathered" chicken).

FIG. 1A provides a front view of an assembled embodiment of a costume apparatus 100. In this figure, is a character head 102, a removable body pod cover 104, two glove covers 106 reversibly coupled (e.g., Velcro) to each side of the removable body pod cover 104, a leg covering 108, or shoes or chicken feet 110.

FIG. 1B provides a side view of an assembled embodiment of a costume apparatus 100. This figure depicts a prop, a lettuce-shaped burlesque fan 112.

FIG. 1C provides a rear view of an assembled embodiment of a costume apparatus 100. This figure depicts an optionally actuatable tail feather 114.

Figures 2A, 2B, 2C:
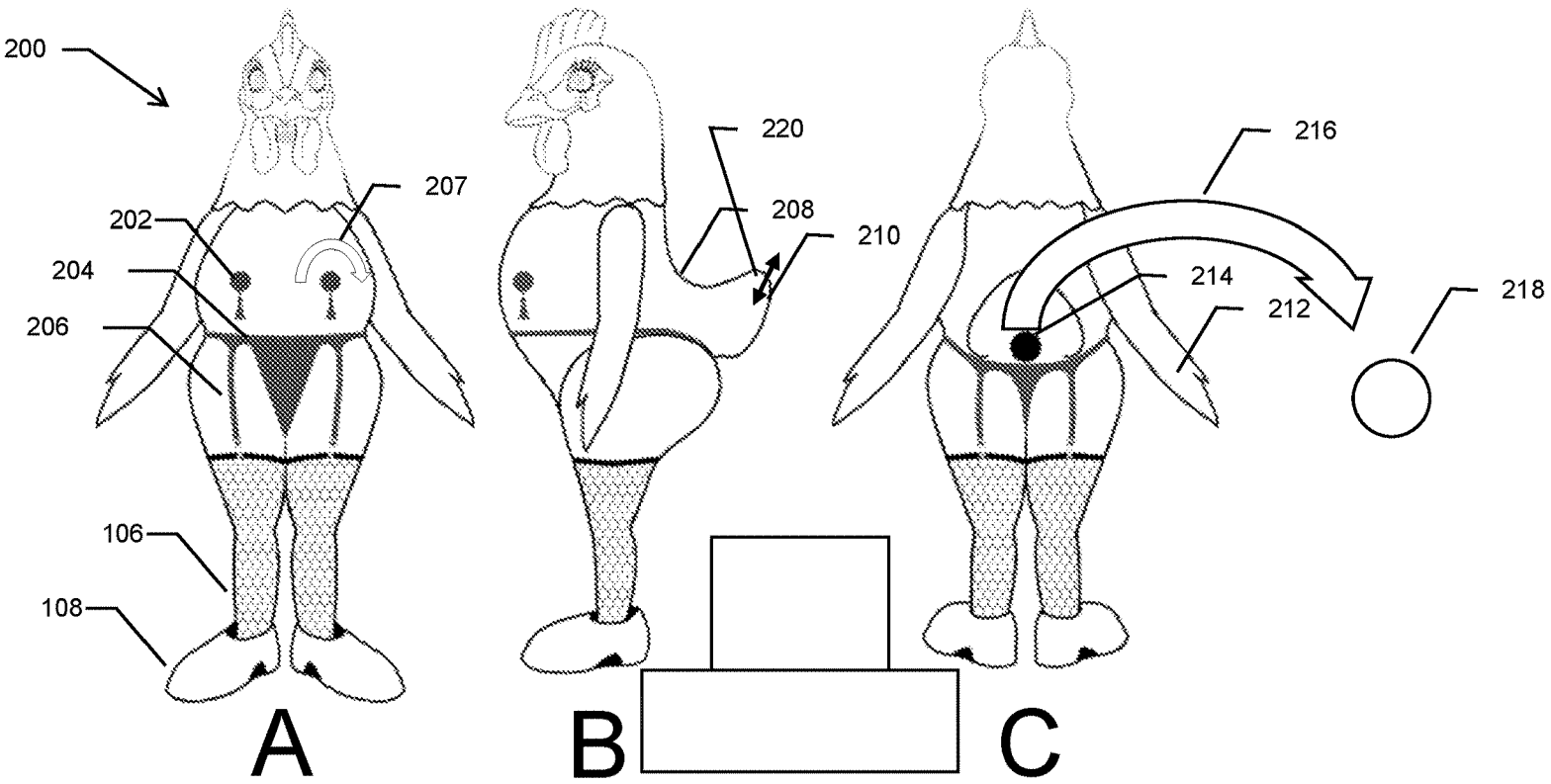
FIG. 2A-FIG. 2C provides a front view (A), a side view (B), and a rear view (C) of the underlying "naked", "defeathered", "plucked", or "stripped" chicken of the costume apparatus of FIG. 1A-FIG. 1C.

FIG. 2A provides a front view of an assembled embodiment of a costume apparatus 200. This figure depicts a pair of tassels 202 (optionally capable of spinning), an undergarment 204, a garter belt 206, leg coverings or fishnet stockings 106, and shoes or chicken feet 108.

FIG. 2B provides a side view of an assembled embodiment of a costume apparatus 200. This figure depicts a body pod 208 and a tail 210.

FIG. 2C provides a rear view of an assembled embodiment of a costume apparatus 200. This figure depicts a glove 212 and a projectile launcher 214.

FIG. 3A provides a front view of an assembled embodiment of a costume apparatus 200. This figure depicts a brassiere 222 (optionally with a quick-release clasp 221), an undergarment 204, a garter belt 206, leg coverings or fishnet stockings 106, and shoes or chicken feet 108.

FIG. 3B provides a side view of an assembled embodiment of a costume apparatus 200. This figure depicts a brassiere 222, a body pod 208, and a tail 210.

FIG. 3C provides a rear view of an assembled embodiment of a costume apparatus 200. This figure depicts a glove 212, a projectile launcher 214, and a projectile (e.g., confetti 219, glitter, egg, ball 218 of FIG. 2C).

Figure 4A:
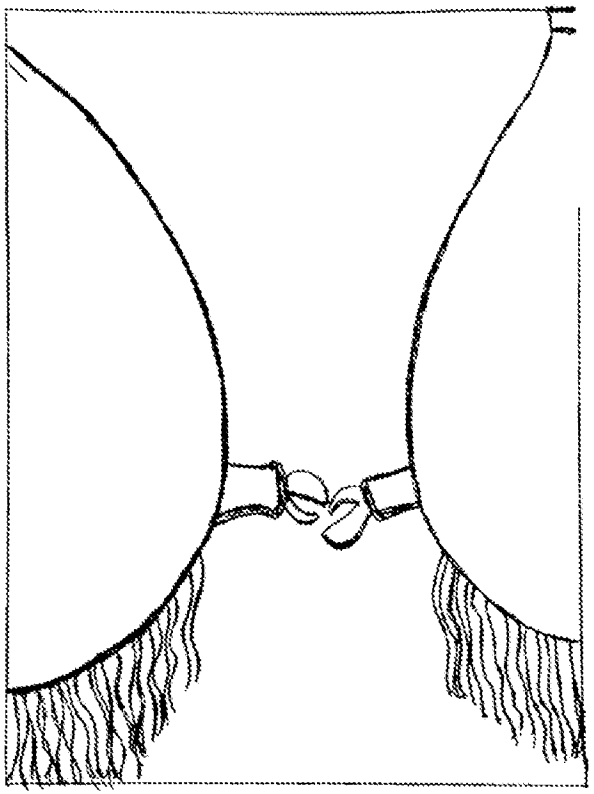
FIG. 4A-FIG. 4B is an image and a close up image of a large halter-style brassiere (in a red color) that can be fitted to fit over either the "feathered" chicken component or the "naked" chicken component.
Figure 4B:
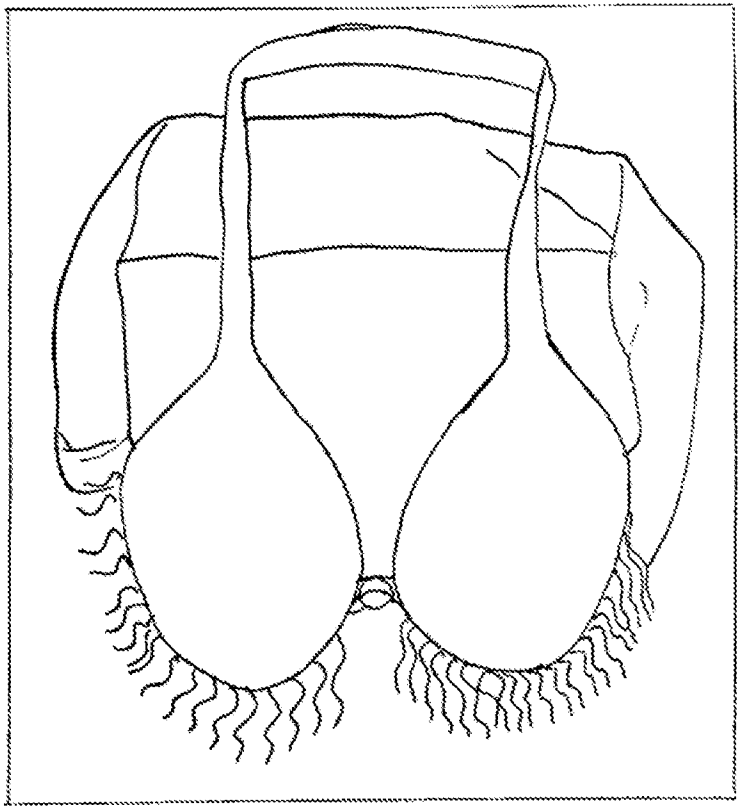

FIG. 4A-FIG. 4B are images of an embodiment of the brassiere component 222 and a close-up view of the quick-release clasp 221.

Figures 5A, 5B, 5C:
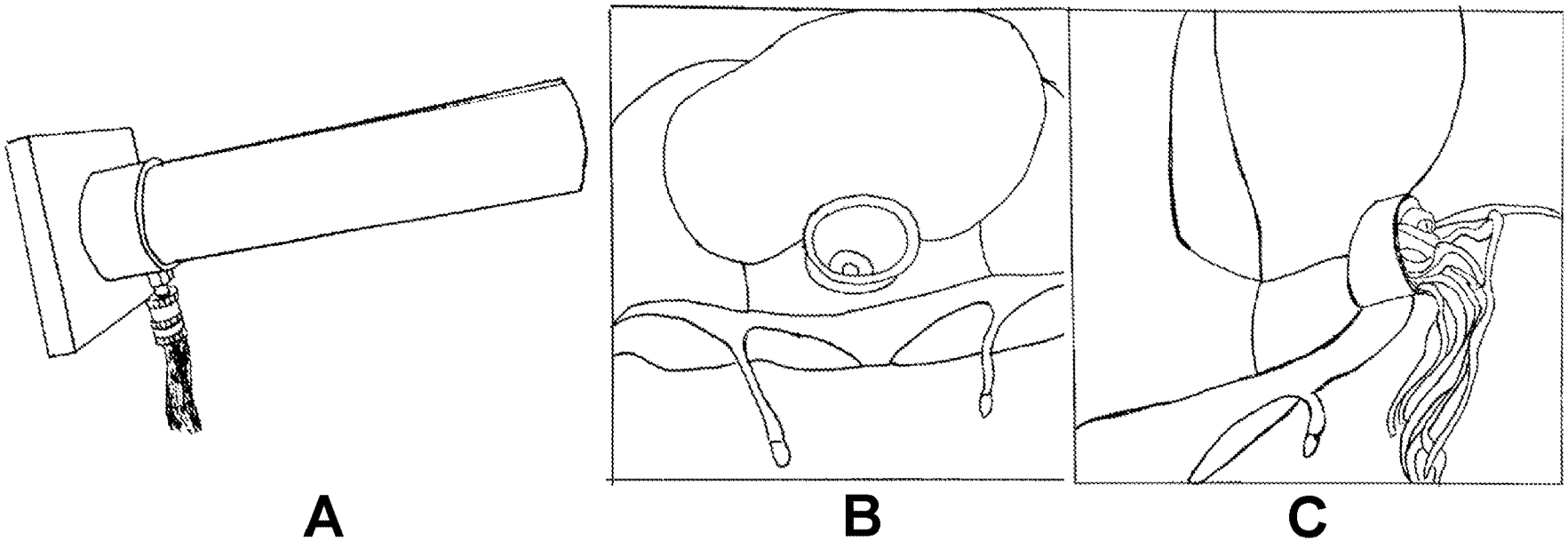
FIG. 5A-FIG. 5B are images of the "rear cannon" or "projectile launcher" in the rear of the "naked" chicken component. An image of the launcher extracted or detached from the costume (A). An image of the launcher as inserted into the costume (B), and an image of a projectile (here, confetti) in the projectile launcher (C).

FIG. 5A-FIG. 5B are images of an embodiment of the projectile launcher that includes a ring pull system on the outside of the naked chicken component (A) (which can also be optionally accessed from the feathered state as well). The launcher also termed a "butt cannon" can be launched or powered by the use of $CO_2$, for example, a $CO_2$ cartridge (B). Pulling the ring releases an amount of $CO_2$ capable of launching a desired projectile.

Figures 6A, 6B, 6C:
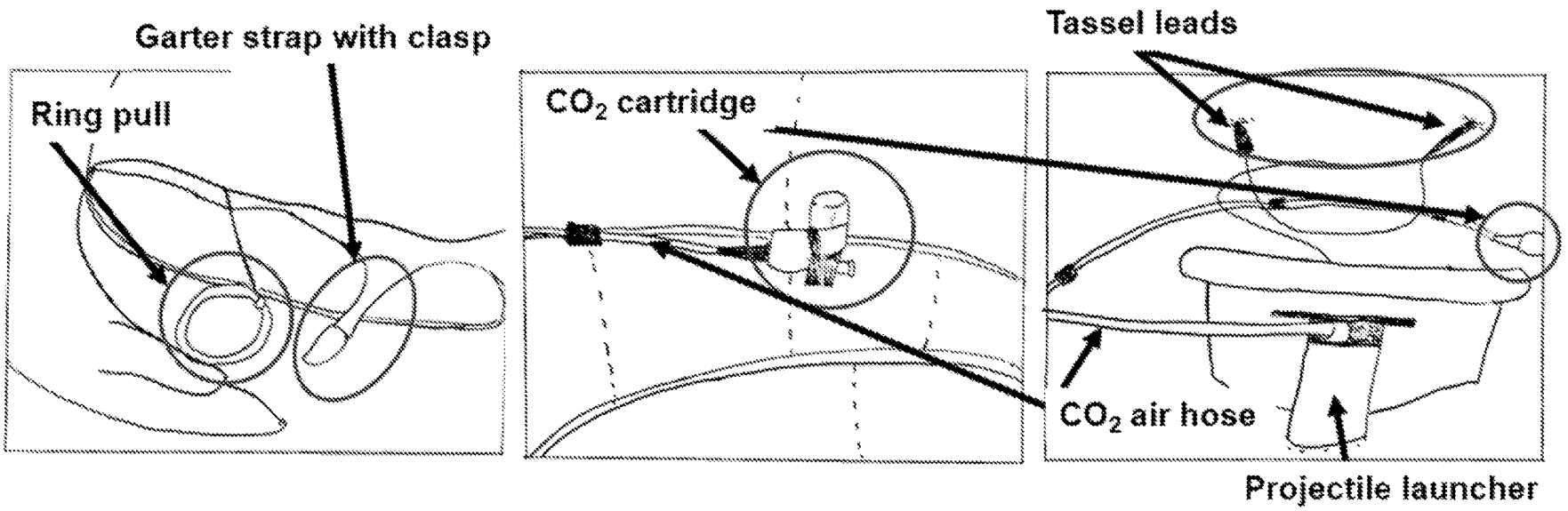
FIG. 6A-FIG. 6C are images of the components of the projectile launching system. The ring pull (A) system capable of deploying the $CO_2$ (B) for an amount of time and in an amount to deploy a desired projectile. For ease of access, a garter strap can be threaded through the ring so that the user can access the ring.

FIG. 6A depicts a ring-pull deployment system for the projectile launcher. For ease of use, this ring pull system can be threaded through the garter strap such that the user can find it easily. FIG. 6B shows the $CO_2$ projectile launching mechanism inside of the costume. FIG. 6C shows the inside of the costume including a ring pull system for the $CO_2$ projectile deployment and the leads for the spinning tassels.

Figure 7:
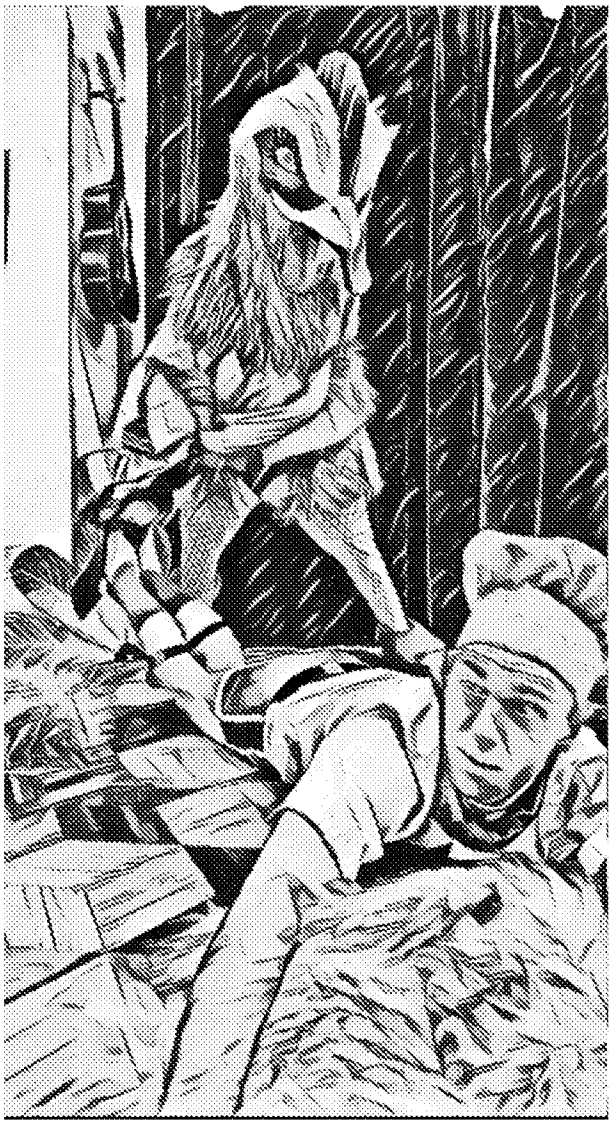
FIG. 7 is an image of a performance in which the costume is being worn by a user. This image features the feathered component, the lettuce leaf fan, and the feathered arm sleeve components (chicken feather arm covering) removed to reveal the "naked" chicken wing skin (chicken skin arm covering). Here, the removable feathered body component is still intact (not removed from the "naked" body pod component) and the "naked" body pod component is underneath the feathered component. In this figure, the head component stays in place.

FIG. 7 is an image of the costume being used in a method of using the costume apparatus and components. This image features the feathered body covering component 104, the lettuce leaf fan 112, the feathered arm sleeve components 106 removed. Here, the removable feathered body component 104 is still intact (not removed from the "naked" body pod component) and the "naked" body pod component 208 is underneath the feathered component.

A chicken head 102, feathered wing 106, or body material 104 can comprise an artificial material to appear like or resemble feathers or fur.

Other variations of the costume apparatus of this invention are possible. For example, FIG. 2C illustrates a costume apparatus 200 with a projectile launcher 214. In the rear view of FIG. 2C, a further embodiment according to the present invention is shown. In FIG. 2C, a costume apparatus 200 has a projectile launcher 214 mounted on the body pod 208 for releasing a projectile (e.g., an egg or an artificial egg, ball, glitter, confetti, etc.).

A first activation step causes the tassels 202 to spin as indicated by arrows 207. A second activation step in FIG. 2C, FIG. 3C shoots a projectile 218 (e.g., egg) or projectile 219 (e.g., confetti, glitter, etc.) out of a projectile launcher 214 as indicated by arrows 216. A third activation step shakes the tail 210 or tail feather 114 as indicated by arrows 220 and 116, respectively.

Another embodiment can be a costume having or not having a pair of tassels. In some embodiment, the costume can comprise a brassiere component 222 (e.g., halter style, standard, etc.), optionally having a quick-release clasp 221 for ease of removal. The brassiere component can comprise a quick-release clasp. In an exemplary embodiment, the brassiere is a halter style with a quick-release clasp for ease of removal during a performance. In some embodiment, the tassels or brassiere component can be worn or utilized on the feathered or the naked component of the chicken costume. In exemplary embodiments, the brassiere or tassels are worn under the feathered chicken costume and on top of the naked chicken costume (see e.g., FIG. 2, FIG. 3).

Methods for use of the disclosed embodiments include a burlesque performance. In some embodiments, the performance can be performed to the music or tune of the chicken dance. In some embodiments, the song or tune of the chicken dance is a sultry rendition of the chicken dance.

In some embodiments, the method comprises a second individual (e.g., in a server, cook, or chef uniform costume) "taking orders" from an audience. The second individual can be an individual, such as an actor, an MC, or comedian that can provide ground rules for the performance (e.g., "don't touch the hot chick", "please find the eggs-it"), perform a chicken-pun filled comedy act (e.g., a "comedi-hen" using chicken puns), and/or cues the performance announcing that someone has ordered chicken strips. The user in the chicken costume arrives to perform.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

Definitions and methods described herein are provided to better define the present disclosure and to guide those of ordinary skill in the art in the practice of the present disclosure. Unless otherwise noted, terms are to be understood according to conventional usage by those of ordinary skill in the relevant art.

In some embodiments, numbers expressing quantities of ingredients, properties such as molecular weight, reaction conditions, and so forth, used to describe and claim certain embodiments of the present disclosure are to be understood as being modified in some instances by the term "about." In some embodiments, the term "about" is used to indicate that a value includes the standard deviation of the mean for the device or method being employed to determine the value.

In some embodiments, the terms "a" and "an" and "the" and similar references used in the context of describing a particular embodiment (especially in the context of certain of the following claims) can be construed to cover both the singular and the plural, unless specifically noted otherwise. In some embodiments, the term "or" as used herein, including the claims, is used to mean "and/or" unless explicitly indicated to refer to alternatives only or the alternatives are mutually exclusive.

The terms "comprise," "have", and "include" are open-ended linking verbs. Any forms or tenses of one or more of these verbs, such as "comprises," "comprising," "has," "having," "includes" and "including," are also open-ended. For example, any method that "comprises," "has" or "includes" one or more steps is not limited to possessing only those one or more steps and can also cover other unlisted steps. Similarly, any composition or device that "comprises," "has" or "includes" one or more features is not limited to possessing only those one or more features and can cover other unlisted features.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the present disclosure and does not pose a limitation on the scope of the present disclosure otherwise claimed. No language in the specification should be construed as indicating any non-claimed element essential to the practice of the present disclosure.

Groupings of alternative elements or embodiments of the present disclosure disclosed herein are not to be construed as limitations. Each group member can be referred to and claimed individually or in any combination with other members of the group or other elements found herein. One or more members of a group can be included in, or deleted from, a group for reasons of convenience or patentability. When any such inclusion or deletion occurs, the specification is herein deemed to contain the group as modified thus fulfilling the written description of all Markush groups used in the appended claims.

All publications, patents, patent applications, and other references cited in this application are incorporated herein by reference in their entirety for all purposes to the same extent as if each individual publication, patent, patent application, or other reference was specifically and individually indicated to be incorporated by reference in its entirety for all purposes. Citation of a reference herein shall not be construed as an admission that such is prior art to the present disclosure.

Having described the present disclosure in detail, it will be apparent that modifications, variations, and equivalent embodiments are possible without departing the scope of the present disclosure defined in the appended claims. Furthermore, it should be appreciated that all examples in the present disclosure are provided as non-limiting examples.

What is claimed is:

1. A costume apparatus, comprising:

a character head having a chicken head appearance suitable for covering a head of a user;

a body pod having a defeathered chicken body shape and defeathered chicken skin appearance; and a removable body pod cover having a chicken feather appearance, wherein the body pod has a chicken breast portion comprising two chicken breasts, and the chicken breast have an operably attached tassel to each breast, wherein each tassel is actuatable, capable of spinning upon activation.

2. The costume apparatus of claim 1, further comprising a pair of first arm coverings suitable for covering arms of a user having a chicken wing skin appearance.

3. The costume apparatus of claim 2, further comprising a pair of second arm coverings having a feathered chicken wing appearance.

4. The costume apparatus of claim 3, wherein the pair of second arm coverings comprises a material selected from feathers, artificial feathers, or artificial fur.

5. The costume apparatus of claim 2, wherein the pair of first arm coverings is separate, attached, or detachable from the body pod.

6. The costume apparatus of claim 3, wherein the pair of second arm coverings are separate or detachable from the body pod.

7. The costume apparatus of claim 1, further comprising a leg covering suitable for covering the legs of a user.

8. The costume apparatus of claim 7, wherein the leg covering has a chicken leg appearance.

9. The costume apparatus of claim 7, wherein the leg covering is selected from fishnet stockings or leggings having a pattern of fishnet stockings printed on the leg covering, thigh highs, leggings, or a bodysuit.

10. The costume apparatus of claim 1, wherein the body pod comprises a tail portion.

11. The costume apparatus of claim 1, wherein the body pod cover comprises a material such as feathers, artificial feathers, or artificial fur material.

12. The costume apparatus of claim 1, further comprising an accessory component selected from character feet having chicken feet appearance, character shoes, high heels, artificial lettuce leaves suitable for use as a burlesque fan, lingerie, a brassiere (bra), a garter belt, fishnet stockings, undergarments, underwear, thong, g-string, a brassiere (bra) having a quick-release clasp, tassels, or a combination thereof.

13. The costume apparatus of claim 1, further comprising a projectile launcher mounted on the body pod suitable for launching a projectile.

14. The costume apparatus of claim 13, wherein the projectile is selected from confetti, glitter, a ball, an egg, or an artificial egg.

15. The costume apparatus of claim 1, further comprising a tail portion on the body pod or tail feathers on the body pod covering, wherein the body pod comprises a mechanism to shake the tail portion of the body pod with or without the body pod covering comprising tail feathers.

* * * * *